US006478606B1

(12) United States Patent
McNerney et al.

(10) Patent No.: US 6,478,606 B1
(45) Date of Patent: Nov. 12, 2002

(54) TWIST-ON CONNECTOR WITH A HEAT-SHRINKABLE SKIRT

(76) Inventors: Gerald McNerney, 6769 Menio Ct., Pleasanton, CA (US) 94588; Dana Rogers, P.O. Box 1338, Morongo Valley, CA (US) 92256

( * ) Notice: Subject to any disclaimer, the term of this patent is extended or adjusted under 35 U.S.C. 154(b) by 0 days.

(21) Appl. No.: 09/666,751

(22) Filed: Sep. 21, 2000

Related U.S. Application Data

(60) Provisional application No. 60/175,407, filed on Jan. 11, 2000.

(51) Int. Cl.[7] ..... H01R 4/24; H01R 4/26; H01R 11/20

(52) U.S. Cl. ..... 439/415; 174/87

(58) Field of Search ..... 439/415; 174/87, 174/84 R

(56) References Cited

U.S. PATENT DOCUMENTS

| | | | | | |
|---|---|---|---|---|---|
| 2,656,204 | A | * | 10/1953 | Blomstrand | 174/87 |
| 2,823,249 | A | * | 2/1958 | Curtiss | 174/87 |
| 3,678,174 | A | | 7/1972 | Gonzhorn | |
| 3,768,941 | A | * | 10/1973 | D'Ascoli et al. | 174/87 |
| 3,814,139 | A | * | 6/1974 | Loyd et al. | 174/87 |
| 3,875,324 | A | | 4/1975 | Waddington et al. | |
| 4,065,637 | A | * | 12/1977 | Allison | 174/87 |
| 4,112,251 | A | | 9/1978 | Scott | |
| 4,220,811 | A | | 9/1980 | Scott | |
| 4,547,240 | A | * | 10/1985 | Zilligen et al. | 158/85 |
| 4,685,757 | A | * | 8/1987 | Elliott | 174/87 |
| 4,924,035 | A | | 5/1990 | Miller et al. | |
| D315,143 | S | | 3/1991 | Blaha | |
| 5,099,088 | A | * | 3/1992 | Usami et al. | 174/76 |
| 5,132,494 | A | | 7/1992 | Burton et al. | |
| 5,298,300 | A | | 3/1994 | Hosoi et al. | |
| D345,962 | S | | 4/1994 | Clifton et al. | |
| 5,369,225 | A | * | 11/1994 | Natwig et al. | 174/84 R |
| 5,378,855 | A | | 1/1995 | Dalalle | |
| 5,393,932 | A | * | 2/1995 | Young et al. | 174/84 R |
| 5,399,810 | A | * | 3/1995 | Hayami | 174/84 R |
| 5,514,836 | A | | 5/1996 | Dalalle et al. | |
| 5,574,258 | A | * | 11/1996 | Blonder | 174/87 |
| 5,894,110 | A | * | 4/1999 | Simmons et al. | 174/87 |
| 5,922,992 | A | | 7/1999 | Kenney et al. | |

* cited by examiner

*Primary Examiner*—Brian Sircus
*Assistant Examiner*—Hae Moon Hyeon
(74) *Attorney, Agent, or Firm*—John Vanden Bosche

(57) ABSTRACT

A twist-on or wire-nut electrical connector having a rigid, electrically insulative shell, a flexible, heat-shrinkable, electrically insulative skirt, and a coil spring within the body for gripping wires which are inserted therein. The provision of a flexible, heat-shrinkable electrically insulative skirt allows for a safer, more secure connection into which more wires or wires with larger diameter insulation can be inserted. When heat is applied, the skirt will shrink around the inserted wires forming better insulation from moisture, providing a more secure mechanical connection, providing a better electrical insulation for wires with their own electrical insulation removed to insert into the connector, and allowing more or larger diameter wires to be inserted and secured. Unlike prior art connectors, the lower skirt either entirely contains or is directly adhered to the open end of the shell and is heat shrinkable.

16 Claims, 4 Drawing Sheets

TWIST-ON CONNECTOR WITH A HEAT-SHRINKABLE SKIRT

This application claims the benefit of U.S. provisional patent application, Ser. No. 60/175,407, filed on Jan. 11, 2000, and titled "Wire Nut with Heat Shrink".

BACKGROUND OF THE INVENTION

1. Field of the Invention

The present invention is concerned with electrical connectors for securing a connection between two or more electrical wire ends, and more particularly to an improved type of connector known as a twist-on or wire-nut connector having a plastic insulating cap or shell containing a wire coil or spring which is adapted to be screwed down on the stripped ends of the wires to be connected.

2. Description of the Prior Art

Wire-nut connectors (also referred to as twist-on or spring connectors) are well known in the art and have been highly effective in providing a simple device for connecting a plurality of electrical wires together, both mechanically and electrically, and have gained a high degree of commercial acceptance. As a result, a wide variety of such devices have been developed in an effort to simplify their design and manufacture, while increasing their effectiveness. Such devices typically include a plastic insulating cap and a helically coiled spring member contained in the cap. The cap acts as an insulating housing around a tapered, helically coiled spring member and provides an conveniently shaped body for gripping the connector. In this manner, the cap can be twisted onto the plurality of wires with installation torque transmitted from the housing to the spring member thereby forming a connection which is both mechanically secure and electrically conductive.

The prior art connectors suffer several disadvantages, which are properly addressed by this invention.

First, the standard wire-nut connector may be subject to mechanical vibration or changing mechanical load, which will tend to work the wires contained within loose. If the wire nut carries any weight or other load, it will tend to hang on one of the wires. Any relative motion between the individual wires will loosen the wire and compromise the electrical connection. In the worst case, one wire may pop out of the connector, forming a safety hazard, while at the same time, creating a situation in which the remaining wires will more easily come loose.

Second, most wire-nuts are completely open to infiltration by moisture or debris. This can cause several problems including oxidation of the conductors which raises the resistance of the connection and produces excess heat while conducting electricity. Infiltration can also cause deterioration of the wire insulation, electrolysis, and moisture actually forming a conduction path to outside the connector.

Third, if any portion of the conductor is exposed outside the relatively short open end of a standard wire-nut, shock hazard will exist. The ends of the wires must be stripped before insertion in a wire-nut. If too much insulation is stripped or if the insulation prevents any of the wires from entering the wire-nut, then some portion of one of the conductors may be exposed. If any one conductor is exposed, the voltage potential from all the wires will be exposed and will form an electric shock hazard.

SUMMARY OF THE INVENTION

According to the present invention, a twist-on connector with a hollow, rigid, insulative cap that is enclosed on an upper or distal end, and open on a proximal end and includes a heat-shrinkable skirt on the open or proximal end will offer a significant improvement over all three of the above disadvantages. Following prior art practices, the hollow, rigid, insulative upper body will be most economically produced through a standard injection molding process as with U.S. Pat. No. 4,924,035 issued to Miller on May 8, 1990. A coil spring, having an outer radial dimension substantially equal to the inner radial dimension of the hollow, rigid, insulative upper body, will be inserted and locked into place in the rigid upper body after its removal from the mold. A heat-shrinkable skirt will be affixed at a predetermined location at the proximal end of the upper body by a chemical and/or mechanical attachment method. The resulting connector of the preferred embodiment will have the appearance of the Dual Durometer Twist-on Connector of U.S. Pat. No. 5,132,494 issued to Burton on Jul. 21, 1992. In contrast to the device described in Pat. No. 5,132,494, however, the lower, flexible portion of the present invention, when treated with a standard heat-gun, will shrink down around the enclosed wires forming a more secure mechanical and electrical connection. The embodiments of the present invention contemplate various processes used to bond the skirt to the rigid body.

DETAILED DESCRIPTION OF THE INVENTION

Figures 1, 2:
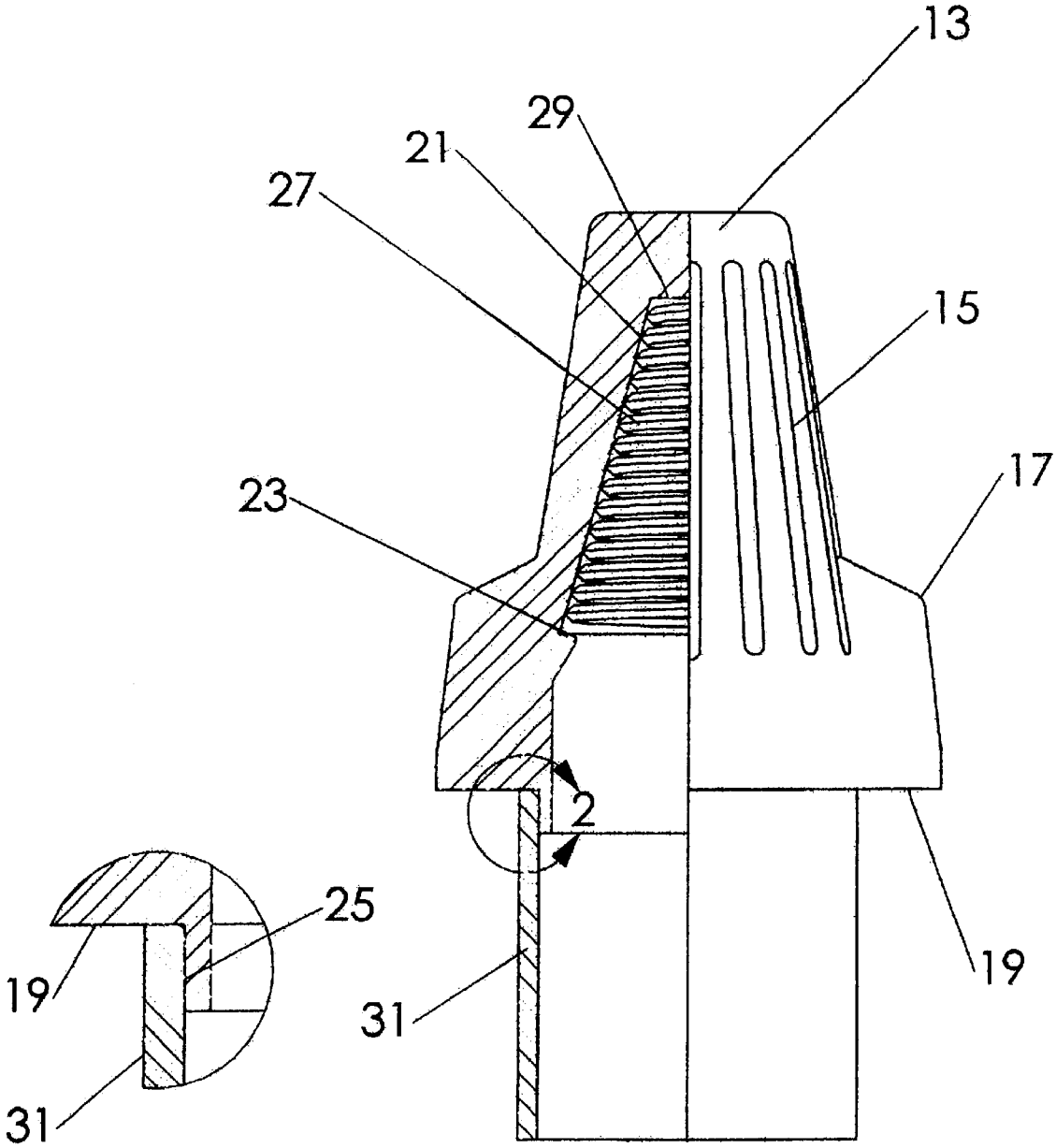
FIG. 1 is a view, partially in section, of the twist on connector according to a first embodiment of the present invention.
FIG. 2 is a detail view taken within circle 2 of FIG. 1.

The invention will be best understood by reference to the accompanying drawings in which:

FIG. 1 shows a first preferred embodiment of the present invention. The invention embodies most features of standard wire nuts, such as those described in U.S. Pat. No. 2,656,204 and U.S. Pat. No. 3,875,324, the specifications of which are incorporated herein by reference. The main body of the wire nut consists of a hard plastic shell 13, with groves 15 and ears 17 for enhanced finger grip. It is to be understood that the grooves 15 and ears 17 are not critical to the present invention and either the grooves 15, the ears 17, or both could be eliminated without affecting the scope of the invention. The shell 13 is closed at a top or distal end 29 and is open at a bottom or proximal end 19 where the wires are inserted. The shell 13 is essentially hollow with a conically shaped cavity 21 into which a spring coil 27 is inserted with a lip 23 for retaining the coil. The opening has an annular projection 25 that extends past the proximal end 19 of the shell 13 as shown in FIG. 2 to form a bond surface for the heat shrink 31.

The coil spring 27 has a tapered profile and fits tightly into the inset 21 inside the shell 13. The coil spring 27 is sized to fit from the top 29 of the inset portion to just above the retaining lip 23.

A tubular sleeve of heat shrink material 31 is attached to the shell 13 at the proximal end 19. Heat shrink material is well known in the art and is commercially available in most hardware stores. The present invention contemplates using a material such as polyvinyl chloride (PVC), polyolefin resins, polyamide resins, polyester resins, butyl rubbers to form the heat shrinkable material, although other materials may be used with equal success. Further description of the materials and processes used in manufacturing heat shrink is not given here. The heat shrink material 31 has a tubular form, which is chemically adhered to a bond surface on an exterior diameter of the annular projection 25. The heat shrink material 31 can be adhered to the annular projection 25 using any appropriate adhesive such as epoxy, PVC cement, cyanoacrylate, or nitro-cellulose. After the heat shrink tube 31 is chemically attached to the annular projection 25, heat can be applied precisely to the portion of the heat shrink 31 that overlaps the annular projection 25 in order to improve the bond.

In use, a group of wires has their end portions stripped as they would for use with a typical prior art connector. The wires are then inserted through the heat shrink tube 31 and through the opening in the proximal end 19 of the shell 13. As the wires enter the cavity 21 in the shell 13, they are twisted so that the coil spring 27 engages the stripped ends of the wires and forms a solid mechanical and electrical connection. The process, as described up to this point, is very similar to the process that would be used with a typical prior art connector. As the wires are inserted into the shell 13 and twisted into the coil spring 27, the heat shrink tube 31 is capable of flexing and deforming to accommodate the insulation on the wires. After the wires are securely twisted into the coil spring 27, a heat gun is used to apply heat to the heat shrink tube 31. This causes the tube 31 to decrease in diameter and form a tight connection with the insulation on the wires, thereby improving the mechanical attachment of the wires and deterring the ingress of moisture or other debris into the wire splice.

Figure 3:
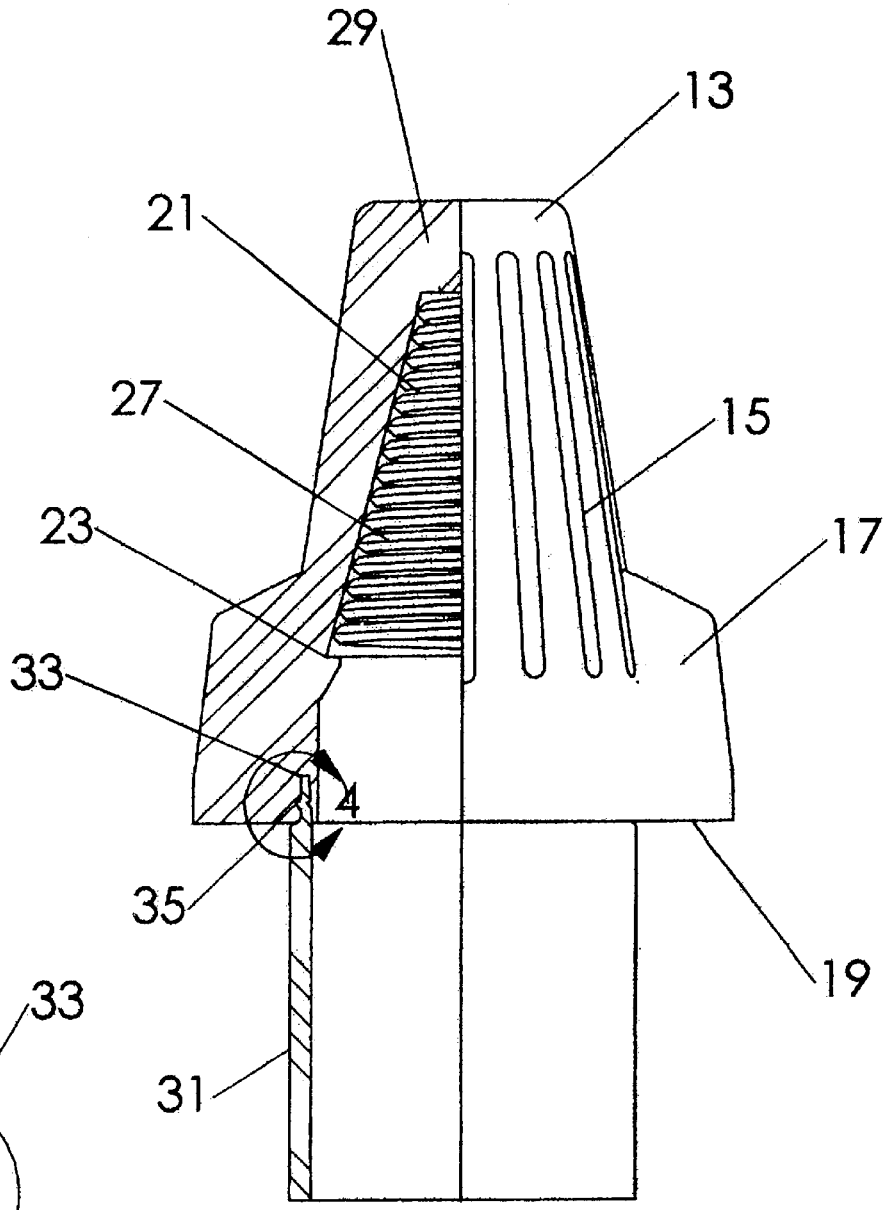
FIG. 3 is a view, partially in section, of the twist on connector according to a second embodiment of the present invention.
Figure 4:
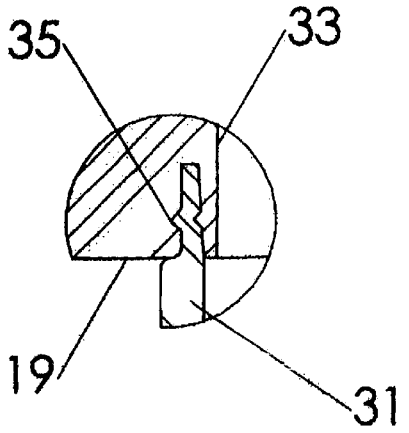
FIG. 4 is a detail view taken within circle 4 of FIG. 3.

FIGS. 3 and 4 show a second preferred embodiment of the present invention in which the heat shrink tube 31 is mechanically attached to the hard plastic shell 13. The second preferred embodiment differs from the first preferred embodiment in that the shell 13 does not have an annular projection on the proximal end 19 for attachment of the heat shrink 31. Instead, the second preferred embodiment includes a recess 33 in the proximal end 19 of the plastic shell 13. A portion of the heat shrink tube 31 is pressed inside of the recess 33 to provide a mechanical bond. The recess 33 includes an irregularly shaped notch 35 that acts as a detent. While FIGS. 3 and 4 show a single notch 35, it is possible that the shell 13 could include more than one notch 35. Also, there may be a chemical adhesive added to the notch 35 so that the heat shrink tube 31 is bonded both mechanically and chemically to further improve the bond.

Figure 5:
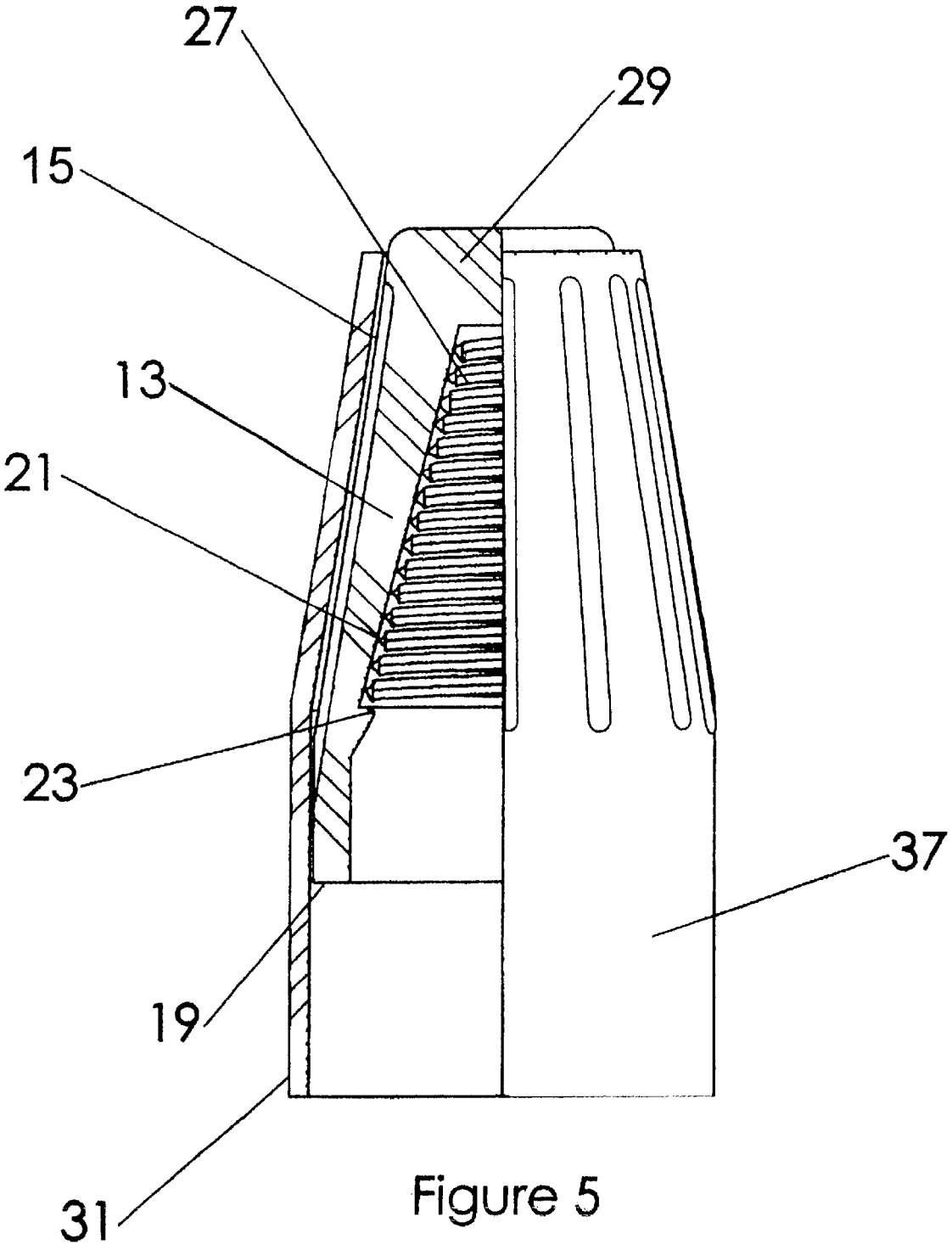
FIG. 5 is a view, partially in section, of the twist on connector according to a third embodiment of the present invention.

FIG. 5 shows a third preferred embodiment of the present invention. In this embodiment, the shell 13 has neither a projection nor a recess on the proximal end 19 of the plastic shell 13. Instead, the shell 13 has a flat surface around the opening at the proximal end 19 similar to a conventional prior art wire connector. The shell 13 is also closed at the distal end 29 and includes grooves 15 to improve the grip of the connector. A tube of heat shrink material 31 overlaps substantially the entire length of the shell 13. As an optional alternative, the heat shrink material 31 can be formed as a sock with a closed end that covers the closed distal end 29 of the shell 13. As part of the manufacturing process, a precise application of heat is directed at the portion of the heat shrink material 31 that overlaps the shell 13 causing the heat shrink material 31 to decrease in diameter and tightly grip the shell 13. In this manner, the heat shrink material 31 is secured to the shell 13 by friction. It is intended that adequate heat is applied to the overlapping portion of the heat shrink 31 so that the dimensions of the heat shrink are reduced to the point where the grooves 15 in the hard plastic shell 13 are replicated in the heat shrink material 31. The replicated grooves 37 in the heat shrink material 31 are shown in FIG. 5. The portion of the heat shrink material 31 that extends beyond the proximal end 19 of the plastic shell 13 is not heated during the manufacturing process so that it retains a large dimension. After wires are inserted into the connector, heat can be applied to the entire connector and the portion of the heat shrink 31 that extends beyond the proximal end 19 shrinks down onto the entrapped wires to form a secure mechanical bond and to deter contaminants from entering the wire splice.

Figure 6:
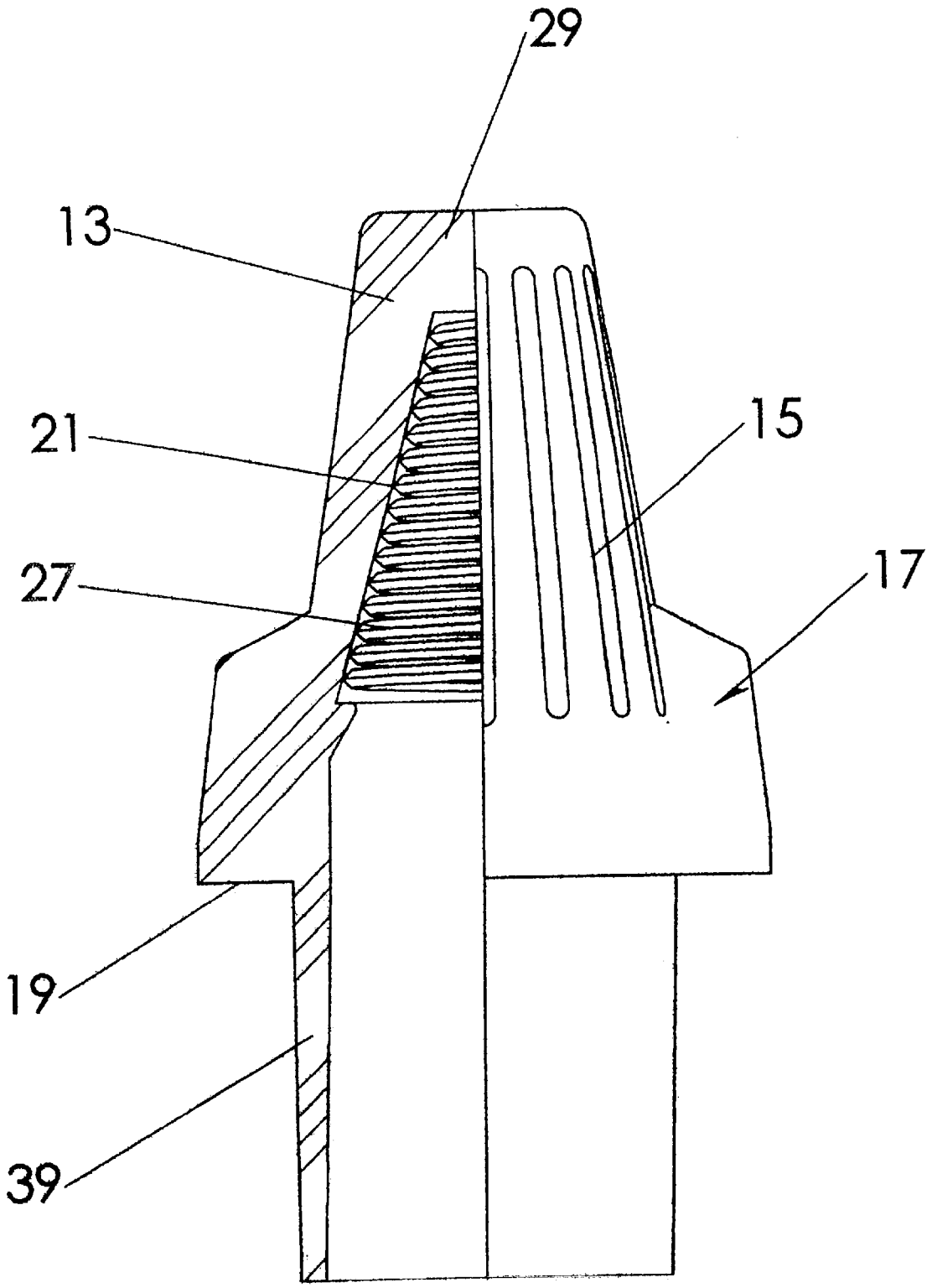
FIG. 6 is a view, partially in section, of the twist on connector according to a fourth embodiment of the present invention.

A fourth preferred embodiment of the present invention is shown in FIG. 6. In this embodiment, the entire shell 13 is formed of heat shrink material. The portion of the shell 13 that encases the coil spring 27 is pre-shrunk during the manufacturing process. The pre-shrunk portion of the shell 13 is thick enough to provide a relatively rigid case for the coil spring 27. The pre-shrunk portion of the shell 13 has the same general shape as the hard plastic shell 13 shown in FIG. 1. The shell 13 includes a conical cavity 21 that houses a coil spring 27. It also includes grooves 15 and ears 17 that assist in gripping the shell 13 and applying torque while screwing wires into the coil spring 27. The proximal end 19 of the shell 13 includes a flat surface similar to a typical prior art wire connector. However, a portion of the heat shrink material that forms the shell 13 extends beyond the proximal end 19 of the main shell body to form a sleeve 39. The sleeve 39 is not pre-shrunk during the manufacturing process and maintains an enlarged diameter. The wall of the sleeve 39 is thin enough to be flexible and allow a plurality of wires to be inserted before heat is applied. After the wires are inserted, heat is applied to the sleeve 39 using a heat gun and the dimensions of the sleeve 39 decrease to form a tight fit over the wires.

In all of the above described embodiments, the inner surface of the heat shrink material 31 (or the sleeve 39 in the fourth embodiment) can be coated with a gel that improves the seal of the heat shrink material 31 against the entrapped wires and further protects the wire splice against the ingress of moisture and debris. The gel can have heat activated properties that allows it to provide an improved bond with the wire insulation.

While preferred embodiments of the invention have been shown and described, it will be apparent to those skilled in the art that various modifications may be made in these embodiments without departing from the scope of the invention. Therefore, it is intended that the invention not be limited to the particular embodiments disclosed but that the scope of the invention be defined by the following claims.

We claim:

1. A twist-on connector for forming an electrical connection between a plurality of electrical wires comprising:

an electrically insulative shell having an internal cavity, a closed distal end, and a proximal end that has an annual opening leading to said internal cavity;

an electrically conductive insert having a first end and a second end, mounted inside the internal cavity of said shell with said first end of said insert located adjacent said distal end of said shell and said second end of said insert located intermediate the distal end and wherein a portion of said shell extending between the distal end of said shell and the proximal end of said shell is substantially rigid and does not change shape when heated, and wherein said sleeve is flexible and heat-shrinkable.

2. The twist-on connector of claim 1 wherein said shell is formed from a material selected from the group consisting of polyolefin resins, polyamide resins, polyester resins, and butyl rubbers.

3. The twist-on connector of claim 1 further comprising a gel coating inside of said shell that bonds with the insulation on said plurality of wires when activated by heat.

4. The twist-on connector of claim 1 wherein said shell is sufficiently thick in a region overlapping said insert to provide a substantially rigid structure whereby torque can be transmitted through said shell to said insert to allow said insert to be screwed onto the stripped ends of said plurality of wires.

5. The twist-on connector of claim 4 wherein said shell is formed with a plurality of grooves formed therein to improve the grip on said shell.

6. A twist-on connector for forming an electrical connection between a plurality of electrical wires comprising:

an electrically insulative shell having an internal cavity, a closed distal end, and a proximal end that has an annual opening leading to said internal cavity; and an electrically conductive insert mounted inside the internal cavity of said shell; and an electrically insulative tubular skirt formed from a heat-shrinkable material, in which a portion of said skirt overlaps at least a portion of said shell and a portion of said skirt extends beyond said proximal end of said shell to form an extension of said internal cavity, wherein said portion of said skirt that overlaps said portion of said shell is pre-shrunk on said shell by heating said portion of said skirt and wherein said portion of said skirt that extends beyond the proximal end of said shell is un-shrunk and retains its heat-shrinkable properties.

7. The twist-on connector of claim 6 wherein said skirt is formed from a material selected from the group consisting of polyolefin resins, polyamide resins, polyester resins, and butyl rubbers.

8. The twist-on connector of claim 6 further comprising a gel coating inside of said shell that bonds with the insulation on said plurality of wires when activated by heat.

9. The twist-on connector of claim 6 wherein said shell includes a flat surface and an annular projection extending from said flat surface and the end of said annular projection defines said proximal end of said shell, and wherein said skirt overlaps said annular projection and is preshrunk on said annular projection.

10. The twist-on connector of claim 6 wherein said skirt overlaps substantially the entire length of said shell and is preshrunk on the entire length of said shell.

11. The twist-on connector of claim 10 wherein said shell includes grooves to improve the grip on said shell and wherein said skirt conforms to the shape of said shell including said grooves.

12. The twist-on connector of claim 10 wherein said shell is sufficiently thick to provide a substantially rigid structure whereby torque can be transmitted through said shell to said insert to allow said insert to be screwed onto the stripped ends of said plurality of wires.

13. A method for connecting a plurality of wires including the steps of:

a. providing a wire connector comprising a substantially rigid, electrically insulative shell, an electrically conductive insert in said shell, and a generally tubular skirt formed of heat-shrinkable material with a portion of said skirt overlapping said shell and portion of said skirt extending beyond an open end of said shell;

b. heating the portion of said skirt that overlaps said shell to heat-shrink said skirt onto said shell but leaving the portion of said skirt that extends beyond said shell unshrunk so that it retains its heat-shrinkable properties;

c. stripping the insulation off of the ends of said wires;

d. inserting the stripped ends of said wires into the insert in said shell to form an electrical and mechanical connection therewith; and e. applying heat to the portion of said skirt that extends beyond said shell to shrink said skirt onto the insulation of said wires.

14. The method of claim 13 wherein said skirt overlaps a portion of said shell but there is a portion of said shell that is not overlapped by said skirt.

15. The method of claim 13 wherein said skirt overlaps the entire length of said shell.

16. The method of claim 13 further comprising the step of chemically bonding said skirt to said shell before heating the portion of said skirt that overlaps said shell.

* * * * *

UNITED STATES PATENT AND TRADEMARK OFFICE

CERTIFICATE OF CORRECTION

PATENT NO. : 6,478,606 B1
DATED : November 12, 2002
INVENTOR(S) : McNerney et al.

It is certified that error appears in the above-identified patent and that said Letters Patent is hereby corrected as shown below:

Column 5,
Line 3, after the words "the distal end and" the following has been inserted -- the proximal end of said shell; and a sleeve attached to said proximal end of said shell to form an extension of said internal cavity --

Signed and Sealed this

Twenty-fourth Day of June, 2003

JAMES E. ROGAN
*Director of the United States Patent and Trademark Office*